US009150823B2

(12) United States Patent
Beisser et al.

(10) Patent No.: US 9,150,823 B2
(45) Date of Patent: Oct. 6, 2015

(54) MICROEMULSION-BASED CLEANING AGENT COMPRISING AN ANIONIC/NONIONIC SURFACTANT MIXTURE

(71) Applicants: Bernd Schwegmann GmbH & Co. KG, Grafschaft-Gelsdorf (DE); Forschungszentrum Jülich Gmbh, Jülich (DE)

(72) Inventors: Renate Beisser, Köln (DE); Jürgen Allgaier, Aachen (DE); Jens Hillerich, Groβ-Umstadt (DE)

(73) Assignees: Forschungzentrum Julich GmbH, Julich (DE); Bernd Schwegmann GmbH & Co. KG, Grafschaft-Gelsdorf (DE)

( * ) Notice: Subject to any disclaimer, the term of this patent is extended or adjusted under 35 U.S.C. 154(b) by 0 days.

(21) Appl. No.: 14/384,185

(22) PCT Filed: Mar. 20, 2013

(86) PCT No.: PCT/EP2013/055791

§ 371 (c)(1),
(2) Date: Sep. 10, 2014

(87) PCT Pub. No.: WO2013/139842

PCT Pub. Date: Sep. 26, 2013

(65) Prior Publication Data

US 2015/0045278 A1 Feb. 12, 2015

(30) Foreign Application Priority Data

Mar. 20, 2012 (DE) ..... 10 2012 204 378

(51) Int. Cl.

| | |
|---|---|
| ***C11D 1/83*** | (2006.01) |
| ***C11D 17/00*** | (2006.01) |
| ***C11D 3/04*** | (2006.01) |
| ***C11D 3/20*** | (2006.01) |
| ***C11D 3/34*** | (2006.01) |
| *C11D 1/12* | (2006.01) |
| *C11D 1/66* | (2006.01) |
| *C11D 1/72* | (2006.01) |
| *C11D 1/74* | (2006.01) |

(52) U.S. Cl.

CPC ..... *C11D 17/0021* (2013.01); *C11D 1/83* (2013.01); *C11D 3/046* (2013.01); *C11D 3/2075* (2013.01); *C11D 3/2079* (2013.01); *C11D 3/2086* (2013.01); *C11D 3/2093* (2013.01); *C11D 3/3472* (2013.01); *C11D 1/123* (2013.01); *C11D 1/667* (2013.01); *C11D 1/72* (2013.01); *C11D 1/74* (2013.01)

(58) Field of Classification Search

CPC ..... C11D 1/8255; C11D 1/123; C11D 1/83; C11D 11/0023; C11D 17/0017; C11D 17/0021

See application file for complete search history.

(56) References Cited

U.S. PATENT DOCUMENTS

| | | | | |
|---|---|---|---|---|
| 4,511,513 | A * | 4/1985 | Guth et al. | 554/59 |
| 5,458,881 | A * | 10/1995 | Berger et al. | 424/401 |
| 5,785,962 | A * | 7/1998 | Hinz et al. | 424/70.22 |
| 6,004,920 | A | 12/1999 | Pollack et al. | |
| 6,165,962 | A | 12/2000 | Kaler et al. | |
| 6,821,937 | B2 | 11/2004 | Gross | |
| 6,982,244 | B2 | 1/2006 | Gross et al. | |
| 7,018,969 | B1 | 3/2006 | Gross et al. | |
| 7,964,545 | B2 * | 6/2011 | Uchiyama et al. | 510/130 |
| 2006/0084589 | A1 * | 4/2006 | Vlad et al. | 510/417 |
| 2008/0200565 | A1 * | 8/2008 | Harwell et al. | 514/785 |
| 2009/0093390 | A1 | 4/2009 | Gross et al. | |
| 2009/0299005 | A1 | 12/2009 | Allgaier et al. | |
| 2010/0093581 | A1 * | 4/2010 | Winston et al. | 510/107 |
| 2010/0144898 | A1 | 6/2010 | Adams et al. | |
| 2011/0229424 | A1 | 9/2011 | Schumann et al. | |
| 2011/0301237 | A1 * | 12/2011 | Calvert et al. | 514/547 |
| 2014/0018277 | A1 | 1/2014 | Adams et al. | |

FOREIGN PATENT DOCUMENTS

| | | | |
|---|---|---|---|
| EP | 0672747 | A2 | 9/1995 |
| EP | 0672747 | A3 | 9/1995 |
| EP | 1 780 259 | A1 | 5/2007 |
| WO | WO 0052128 | | 9/2000 |
| WO | WO 2006004721 | A1 | 2/2006 |

OTHER PUBLICATIONS

Abstract of European Patent—EP2045320, Apr. 8, 2009, 2 pages.
International Search Report for PCT/EP2013/055791 dated May 29, 2013, 2 pages.

* cited by examiner

*Primary Examiner* — Charles Boyer
(74) *Attorney, Agent, or Firm* — Dority & Manning, P.A.

(57) ABSTRACT

The present invention relates to an aqueous microemulsion, comprising a) one or more liquid carboxylic acid esters, b) one or more water-soluble salts having one or more cations, preferably selected from the group comprising sodium, potassium, calcium, magnesium, and ammonium, c) one or more salts of sulphosuccinic acid ester, d) one or more non-ionic surfactants selected from alkoxylated sorbitan ester and alkoxylated vegetable oil, and e) one or more boosters.

30 Claims, No Drawings

MICROEMULSION-BASED CLEANING AGENT COMPRISING AN ANIONIC/NONIONIC SURFACTANT MIXTURE

CROSS REFERENCE TO RELATED APPLICATIONS

This application is the national stage entry of International Patent Application No. PCT/EP2013/055792 having a filing date of Mar. 20, 2013, which claims priority to and the benefit of German Patent Application No. 10 2012 204 378.0 filed in the German Patent and Trademark Office on Mar. 20, 2012, the entire contents of which are incorporated herein by reference.

The invention relates to aqueous microemulsions, to the use thereof as cleaning agents, especially for removing polymer-like soils, such as paint residues, and to a process for cleaning using the aqueous microemulsions.

Cleaning agents usually derive their effectiveness from the fact that they are especially designed for the soils to be cleaned. A cleaner for water-soluble soils is typically water-based, whereas a cleaner for oil-like soils is typically oil-based. A cleaner acting against both kinds of soils consists of water, an oil and at least one surfactant, so that emulsions can form.

Surfactants are detergent substances contained in laundry detergents, dishwashing detergents and shampoos. They have a characteristic structure and include at least one hydrophilic and one hydrophobic moiety. They have an amphiphilic character. If the stabilizing effect on water-oil mixtures is the important characteristic, then these amphiphilic substances are employed as emulsifiers.

Surfactants reduce the interfacial tension between immiscible phases, a hydrophilic (water-soluble, lipophobic), mostly aqueous, phase and a hydrophobic (oil-soluble, lipophilic) phase.

Such aqueous two-phase mixtures are referred to as "emulsions".

Conventional emulsions may contain hydrophilic and hydrophobic phases in different volume proportions. They include a continuous phase and a disperse phase which is contained in the continuous phase in the form of very small spheres stabilized by surfactants occupying their surface. Depending on the nature of the continuous phase, the emulsions are referred to as "oil-in-water" or "water-in-oil".

A fundamental distinction is made between emulsions and microemulsions. While microemulsions are thermodynamically stable, emulsions will segregate into two phases due to their instability. On a microscopic scale, this difference is manifested in the fact that the emulsified liquids in microemulsions usually have smaller structure sizes as compared to emulsions, as described in DE 10 2005 049 765 A1. Thus, thermodynamically unstable emulsions have larger structures.

In microemulsions, lamellar mesophases may occur. Lamellar mesophases result in optical anisotropy and possibly increased viscosity. Such properties are undesirable for cleaning agents, for example. In addition, phase separation occurs when lamellar phases coexist with microemulsions.

Microemulsions consist of at least three components, namely oil, water and a surfactant. The surfactant mediates between these two components and allows for a macroscopically homogeneous mixture. On a microscopic scale, the surfactant forms a film between the oil and water domains. Oil and water are not miscible and therefore form domains on a nanoscale. Microemulsions are macroscopically homogeneous, have an optically isotropic behavior and, in contrast to emulsions, are thermodynamically stable. There are w/o and o/w droplet microemulsions, wherein water droplets are surrounded by oil, or oil droplets are surrounded by water. About equal proportions of oil and water favor the formation of a bicontinuous microemulsion. Characteristic of the efficiency of a surfactant is the minimum amount of surfactant required to obtain a microemulsion.

Microemulsions have been intensively studied in the field of fundamental science. The knowledge gained thereby is substantially based on the use of pure and defined components: deionized water, chemically pure oils and pure surfactants. With technical microemulsions, the components usually consist of mixtures of substances. This considerably changes the ratio of the phases, and the knowledge gained from simplified models in fundamental research cannot be transferred to technical applications so easily. Another difficulty resides in the low thermal stability of microemulsions, since practical formulations require stability over a broad range of temperatures in order to ensure safe storage, shipping and a safe application. Especially systems based on the widely used fatty alcohol ethoxylates are stable only in a very narrow temperature window of a few ° C., or must have extremely high surfactant concentrations to be stable over larger temperature ranges. In contrast, microemulsions prepared by means of sugar surfactants may be stable over broader temperature ranges (WO 2008/132202 A1). Similarly, mixtures of non-ionic and ionic surfactants may also be employed. In this case, the complementary thermal behavior of the non-ionic and ionic surfactants is utilized. However, the development of microemulsions that can sensitively respond to adjustment of their parameters and are at the same time stable and exhibit a high cleaning performance, especially in view of materials insoluble or hardly soluble in water, is a particular challenge.

At the same time, ecological aspects and health aspects play an increasingly important role, so that it is taken care that surfactants be used that include a low hazard potential. For technical applications, this may be of great importance since surfactant contents of 20-30% are usual in conventional microemulsions in order to achieve a sufficiently broad temperature stability. In such concentrations, surfactants have a hazard potential that is no longer negligible.

Conventional cleaners, which are used in the commercial and private fields, for example, as paintbrush cleaners or adhesive removers, essentially consist of lower-boiling mixtures of aliphatic and aromatic hydrocarbons or other organic solvents, which are often admixed with surfactants. Such cleaners are highly harmful to health and to the environment. In addition, conventional cleaners are often strongly alkaline, which can attack the substrates to be cleaned.

In addition, conventional cleaners have a strong defatting effect upon contact with the skin, and also have a strong smell.

Technically employable microemulsions are already known in the prior art. Thus, DE 10 2005 049 765 generally describes a process for cleaning with microemulsions by means of hydrophilic polymeric additives.

U.S. Pat. No. 6,165,962 describes microemulsions containing sodium salts of sulfosuccinate esters, $C_2$-$C_{10}$ dials and oil. The oil component can be an ester. The microemulsions may contain further solvents and are suitable as cleaners for defatting or for paint stripping.

US 2009/0093390, U.S. Pat. No. 7,018,969, US 2005/0130869 and WO 2006/004721 describe microemulsion formulations for cleaning hard surfaces, containing polar solvents as well as surfactants and cosurfactants in addition to ester oils.

US 2004/0038847 and WO 00/52128 describe microemulsions for cleaning hard surfaces, containing polar solvents and anionic surfactants as the surfactant component, in addition to ester oils.

EP 1 780 259 describes microemulsions for cleaning hard surfaces, containing polar solvents and anionic surfactants in addition to dibasic esters.

The microemulsions based on ester oils as described in the prior art require further solvents to stabilize the microemulsion or to achieve the cleaning performance, and are thus usually require hazard labels according to the current German legal situation.

It is the object of the present invention to provide environment-friendly microemulsions that are stable over a broad temperature range, contain a low amount of surfactants, and additionally have an excellent cleaning performance, especially in view of paint soils, oily and fatty soils, and soils whose organic components are polymer-based, and more preferably, the microemulsions do not require hazard labels according to the current German legislation.

It is the object of the present invention to solve the problems indicated in the prior art.

Surprisingly, it has been found that the object can be achieved by a specific microemulsion.

The present invention relates to an aqueous microemulsion, comprising:

a) one or more liquid carboxylic acid ester(s);
b) one or more water-soluble salt(s) with one or more cation(s), preferably selected from the group consisting of sodium, potassium, calcium, magnesium and ammonium;
c) one or more salt(s) of sulfosuccinate esters;
d) one or more non-ionic surfactant(s) selected from alkoxylated sorbitan ester and alkoxylated vegetable oil; and
e) one or more booster(s).

The cleaning performance of the microemulsions according to the invention are essentially the same as those of the solvent-based cleaners. However, the microemulsions according to the invention additionally have a broader range of application. For example, they are suitable for removing fresh or dried water-based paints. Such paints are normally removed by water, which may lead to resinous residues or residues of partially dried paint, however. Resinous residues can agglutinate paintbrush bristles, for example. The microemulsions according to the invention are also suitable for removing water-soluble paints without leaving resinous residues. Partially dried paint is removed, which is not possible with water. Conventional paintbrush cleaners are suitable only for cleaning solvent-based paints, but are unsuitable for water-based paints. The microemulsions according to the invention are further advantageous when long exposure times are necessary, for example, for removing dried soils. Conventional cleaners are not suitable in such a case, because the organic solvents evaporate quickly.

In addition, it has been found that the microemulsions according to the invention can be readily diluted with water while maintaining their microemulsion property. Thus, they can be employed in a water-diluted form for soils that are easy to remove. In addition, cleaner residues can be readily removed with water.

In addition, it has surprisingly been found that the microemulsions according to the invention leave a pleasant feeling on the skin after contact with the skin and after rinsing, in contrast to conventional cleaners. In addition, the microemulsions according to the invention are essentially odorless.

The microemulsions according to the invention are also characterized in that they require only a small amount of surfactant and are stable within a broader temperature range.

In a preferred embodiment, the microemulsion according to the invention is essentially free of volatile organic compounds (VOC) A volatile organic compound having a vapor pressure of 0.01 kPa or more at 293.15 K is to be considered a VOC according to the 31st Ordinance on the Implementation of the Federal Immissions Control Law (31. BimschV, §2, No. 11). VOCs include, for example, compounds of the alkanes/alkenes, aromatics, terpenes, halogenated hydrocarbons, ethers, esters, aldehydes and ketones.

Preferably, the microemulsion of the present invention is essentially free of organic solvents, especially of VOCs. "Essentially free" within the scope of the present invention means that the microemulsion contains less than 10% by weight, preferably less than 5% by weight, more preferably less than 2% by weight, even more preferably less than 1% by weight, especially less than 0.5% by weight, and in particular, is completely free.

The aqueous microemulsion according to the invention includes components a) to e) as essential components.

Component a)

The aqueous microemulsion according to the invention includes one or more liquid carboxylic acid ester(s), also referred to as "ester oils" in the following, as component a). The ester oil represents the oil component in the microemulsion. Ester oils have the advantage of being non-polar and having a lipophilic character, which makes them particularly suitable for oily soils and, in particular, also for soils whose organic components are polymer-based. In addition, they have a high boiling point and are therefore hardly volatile. Suitable liquid carboxylic acid esters have a melting point of below 20° C., i.e., the liquid carboxylic acid esters are liquid at 20° C.

Suitable carboxylic acid esters have from 6 to 40 carbon atoms, preferably from 6 to 22 carbon atoms, especially from 10 to 22 carbon atoms.

The ester oil may contain saturated, unsaturated or aromatic radicals.

Particularly preferred are liquid carboxylic acid esters selected from the group consisting of esters of a monohydric alcohol and a mono- or dicarboxylic acid, and esters of a dihydric alcohol and a monocarboxylic acid.

Particularly preferred are the esters of monohydric alcohols with monocarboxylic acids.

Good results could be achieved with liquid carboxylic acid esters in which the ester is derived from a $C_{10}$-$C_{22}$ monocarboxylic acid and methanol, preferably dodecanoic acid methyl ester or rapeseed oil methyl ester.

Further preferred are liquid carboxylic acid esters containing a mixture of monocarboxylic acids with 10 to 22 carbon atoms and dicarboxylic acid methyl esters with 6 to 10 carbon atoms.

In a particularly preferred embodiment, the ester oil has one or more components selected from the group consisting of rapeseed oil methyl ester, octyl octanoate, oleic acid ethyl ester, methyl laurate, dimethyl succinate, dimethyl adipate, dimethyl glutarate, and isopropyl myristate.

In a preferred embodiment, the aqueous microemulsions of the present invention contain the liquid carboxylic acid ester in an amount of from 10 to 40% by weight, preferably from 20 to 35% by weight, respectively based on the total weight of the microemulsion.

In order to obtain a well-balanced microemulsion adjusted to the other components and showing a high performance, it has proven advantageous to adjust the weight ratio of the liquid carboxylic acid ester (component a)) to the sum of components c), d) and e) to from 1.5 to 10, preferably from 2.5 to 8, especially from 3 to 8, or from 4 to 8.

Component b)

The aqueous microemulsions according to the invention include one or more water-soluble salt(s) with one or more cation(s), preferably selected from the group consisting of sodium, potassium, calcium, magnesium and ammonium, as component b).

Within the scope of the present invention, salts are considered to be water-soluble if at least 1 g of salt per liter of water can be dissolved completely at 20° C. The alkali or alkaline earth or ammonium salts are preferred.

It has been found that the formation of the microemulsion and its temperature stability window can be controlled by suitably selecting the salts. Without the presence of salts, either a very large proportion of surfactant is necessary in the emulsion, or the microemulsion is stable within a temperature range that is irrelevant to the application. Therefore, by using the salt, the amount of surfactant can be reduced, which also entails cost advantages, in addition to advantages for the environment. The amount of surfactant is in turn a matter of balance, because when the amount of surfactant is larger, the temperature range in which the microemulsion is stable becomes broader.

Both inorganic and organic anions are suitable as counter ions. Preferred inorganic anions are selected from the group consisting of sulfate, chloride, hydrogensulfate, phosphate and hydrogensulfate.

Preferred organic anions are selected from the group consisting of acetate, gluconate, citrate and tartrate.

In a particularly preferred embodiment of the present invention, component b) is a water-soluble salt selected from the group consisting of sodium sulfate, sodium chloride, sodium gluconate, sodium citrate, trisodium phosphate, disodium hydrogenphosphate, potassium sulfate, potassium chloride, ammonium sulfate, ammonium chloride, magnesium sulfate, magnesium chloride, calcium chloride, calcium acetate, magnesium acetate, and potassium sodium tartrate.

Surprisingly good results could be achieved with acetate salts. In a particularly preferred embodiment, the microemulsions according to the invention contain calcium acetate and/or magnesium acetate.

In order to adjust the temperature window and to optimize the cleaning performance of the microemulsion according to the invention, the salt is typically present in an amount of from 0.1 to 4% by weight, preferably from 0.25 to 3% by weight, respectively based on the total weight of the microemulsion.

Component c)

The aqueous microemulsion according to the invention additionally contains component c), which is one or more salt(s) of sulfosuccinate ester.

In a preferred embodiment, the salt of sulfosuccinate esters is an alkali metal salt, especially a sodium salt. The salt of sulfosuccinate esters acts as an anionic surfactant. In particular, sulfosuccinate ester salts having $C_6$-$C_{12}$ alcohol radicals have proven particularly suitable for the microemulsions according to the invention. The sulfosuccinate ester salt employed contributes substantially to the stability of the microemulsion according to the invention. More preferably, the salts of sulfosuccinate esters are selected from the group consisting of diesters of sulfosuccinic acid alkali salt with $C_6$-$C_{10}$ alcohols, monoesters of sulfosuccinic acid dialkali salt with $C_8$-$C_{12}$ alcohols, and monoesters of sulfosuccinic acid dialkali salt with ethoxylated $C_{10}$-$C_{14}$ alcohols.

In one embodiment, the diester of the sulfosuccinic acid alkali salt is a diester having at least one, preferably two, ethoxylated $C_{10}$-$C_{14}$ alcohol radicals.

The alcohol radicals may be linear or branched. In a particularly preferred embodiment, the salt of sulfosuccinate esters is the sodium salt of bis(2-ethylhexyl) sulfosuccinate.

In order to adjust an optimum aqueous microemulsion according to the invention, the salts of the sulfosuccinate esters are typically present in an amount of from 1 to 10% by weight, preferably in an amount of from 1.5 to 5% by weight, or from 2.0 to 5.0% by weight, respectively based on the total weight of the microemulSion.

Based on the total weight of components c), d) and e), the salt of the sulfosuccinate esters is typically present in an amount of from 30 to 75% by weight, preferably in an amount of from 40 to 70% by weight.

Component d)

As another essential component, the microemulsions according to the invention include component d), which is one or more non-ionic surfactant(s) selected from alkoxylated sorbitan ester and alkoxylated vegetable oil.

In a preferred embodiment, the non-ionic surfactant is selected from ethoxyiated sorbitan ester and/or ethoxylated vegetable oil.

Preferred sorbitan esters include the sorbitan monoesters, especially those sorbitan monoesters having a saturated or unsaturated, linear or branched fatty acid radical.

Alkoxylated sorbitan esters, which may be in a propoxylated and/or ethoxylated form, for example, can be employed in principle. However, ethoxylated sorbitan esters, especially those sorbitan esters having an average of 3 to 30, preferably 4 to 20, ethoxylate groups are particularly preferred.

In a preferred embodiment, the non-ionic surfactant is an ethoxyiated sorbitan monoester with a saturated or unsaturated $C_{12}$-$C_{18}$ fatty acid radical.

In another embodiment, the non-ionic surfactant is an alkoxylated, especially ethoxylated, castor oil.

In a preferred embodiment of the present invention, the degree of ethoxylation of the ethoxylated sorbitan ester and/or of the ethoxylated vegetable oil is adjusted in such a way that the HLB value is from 11 to 17, more preferably from 12 to 16, or from 13 to 16.

The HLB value is calculated as follows according to Griffin:

$$HLB=20\times M_h/M, \text{ where}$$

$M_h$=molecular weight of the hydrophilic part of a molecule; and

M=molecular weight of the entire molecule.

(Griffin, W. C. Classification of Surface Active Agents by HLB, J. Soc. Cosmet. CHEM. 1, 1949).

In a specific embodiment, the non-ionic surfactant is selected from the group consisting of polyoxyethylene(4) sorbitan monolaurate, polyoxyethylene(20)sorbitan monopalmitate, and polyoxymethylene(20)sorbitan monooleate.

The non-ionic surfactant is preferably present in an amount of from 1.0 to 7.0% by weight, more preferably from 1.5 to 5.0% by weight, or from 1.0 to 5.0% by weight, based on the total weight of the microemulsion.

In a particularly preferred embodiment, the non-ionic surfactant is present in an amount of from 10 to 70% by weight or from 20 to 60% by weight, preferably in an amount of from 15 to 60% by weight or from 23 to 55% by weight, respectively based on the total weight of components c), d) and e).

Component e)

As another component e), the aqueous microemulsions according to the invention contain one or more boosters.

The boosters employed serve to increase the surfactant effectiveness in the microemulsions according to the invention. In addition, the boosters contribute to enlarging the temperature range in which the microemulsions are stable. The boosters of the present invention are commonly designed to increase the stability of the microemulsions by stiffening the interface.

According to the invention, boosters are employed that consist of at least one water-soluble moiety that has at least one hydrophobic moiety on at least one chain terminal, and/or a hydrophobic moiety as a non-terminal substituent, and/or has at least one hydrophobic moiety incorporated between the water-soluble moieties of the polymer.

The booster is typically in the form of a polymer. In the overall polymeric booster, the hydrophilic character is predominant. Because of the hydrophobic moiety or moieties, the polymers preferably form micelles in water. Suitable boosters are described, for example, in DE 198 39 054 and DE 10 2005 049 765.

The design of the water-soluble moiety of the booster is not limited to any particular structural types, but the combination of the larger water-soluble moiety with the hydrophobic moiety or moieties is important according to the invention.

The water-soluble moiety of the polymer is preferably linear, but star-shaped, branched or other structural types are also possible. "Linear" as applied to polymers means that the atoms forming the skeleton of the chain are a linear unit.

The water-soluble moiety may be non-ionic or ionic in nature, i.e., be a polyelectrolyte. The electric charges can be positioned at any part of the water-soluble component of the polymer. Structures composed of at least one ionic and one non-ionic portion are also conceivable.

In an illustrative and non-limiting way, the water-soluble moieties can consist of the following monomers or mixtures of at least two components thereof: ethylene oxide, vinyl pyrrolidine, acrylic acid, methacrylic acid, and maleic anhydride.

The water-soluble portion of the polymeric additive is preferably a polyethylene oxide or polyethylene glycol. Further examples include copolymers of ethylene oxide and propylene oxide, polyvinyl alcohol and its water-soluble derivatives. In addition, polyvinylpyrrolidone, polyvinylpyridine, poly(maleic anhydride), poly(maleic acid), poly(acrylic acid), poly(methacrylic) acid, poly(styrenesulfonic acid), and water-soluble salts thereof are suitable.

The water-soluble moieties are preferably linear.

The molecular weight distribution of the water-soluble moiety, defined by the ratio of the weight average molecular weight to the number average molecular weight, is preferably $\leq 1.2$.

The number average molecular weight of the water-soluble moiety of the polymeric additive is preferably from 500 to 20,000 g/mol, more preferably from 1000 to 7000 g/mol, or from 1300 to 5000 g/mol.

A linear water-soluble polymer bearing a hydrophobic group at its chain terminal is preferred.

In a way similar to that for the water-soluble portion of the polymeric additive, the design of the hydrophobic moiety is not limited to selected structural types. Rather, what is only important here are the hydrophobic or water-insoluble properties of such moiety.

Preferred molecular sizes for the hydrophobic moiety are from 80 to 1000 g/mol, more preferably 110-500 g/mol, especially preferably from 110 to 280 g/mol.

The hydrophobic moieties consist of water-insoluble radicals. These are preferably alkyl radicals, preferably those containing from 6 to 50 carbon atoms, more preferably from 8 to 20 carbon atoms. The radicals may also contain aromatic groups or carbon-carbon double or triple bonds, and may be linear or branched. In addition to hydrocarbyl radicals, any other hydrophobic organic radicals, which contain oxygen, nitrogen, fluorine or silicon atoms, for example, can also be employed. The hydrophobic moiety may also be a polymer.

The hydrophobic moiety may be a radical having a defined structure and molecular weight, such as alkyl radicals. Mixtures of substances, as occur in technical products, for example, are also possible. However, it may also be a polymeric radical, such as polybutylene oxide.

The water-soluble moiety of the polymer bears a hydrophobic moiety on at least one chain terminal.

On each chain terminal, more than one hydrophobic moiety is also possible. The water-soluble moiety of the polymer may bear a hydrophobic moiety in a non-chain terminal position.

Further, hydrophobic moieties of the polymeric booster may be incorporated between the water-soluble moieties on at least one site, so that the water-soluble moieties of the polymer are interrupted by hydrophobic moieties.

Any combinations of the stated structural types are possible.

The ratio of the molecular weight of the water-soluble portion to that of the hydrophobic portion is typically 3-300, preferably 5-200, more preferably 5-50.

In the preferred form, the water-soluble moiety of the booster is a linear polymer bearing a hydrophobic moiety on one chain terminal.

The following polymeric boosters can be mentioned as examples:

- alkyl ethoxylates obtained by ethoxylation of $C_8$-$C_{20}$ alcohols;
- alkyl ethoxylates obtained by ethoxylation of $C_{10}$-$C_{20}$ 1,2-diols;
- alkyl ethoxylates obtained by ethoxylation of $C_8$-$C_{20}$ $\alpha,\omega$-diols;
- polyethylene glycol having a hydrophobic modification on both chain terminals, which may be obtained, for example, by reacting polyethylene glycol with $C_8$-$C_{20}$ isocyanates or $C_8$-$C_{20}$ acid chlorides;
- AB diblock copolymers, ABA or BAB triblock copolymers of 1,2-butylene oxide and ethylene oxide.

Particularly effective and at the same time biodegradable are the alkyl ethoxylates obtained by ethoxylation of $C_8$-$C_{20}$ alcohols.

Because of the hydrophobic moieties, the boosters preferentially form micelles in water.

In one embodiment, a hydrophobic moiety is present on each of both ends of the water-soluble moiety.

Linear water-soluble polymers bearing a hydrophobic moiety on only one chain terminal are preferred as boosters according to the invention. Within this structural type, alcohol ethoxylates having a high degree of ethoxylation are preferred. These substances can be considered as a polyethylene oxide with a hydrophobic alkyl radical, or as long-chained or hydrophilic emulsifiers. Aliphatic alcohols or alkylphenols, preferably those having 8-20 carbon atoms, for example, may be used as hydrophobic components. The alcohol ethoxylates preferably contain 25 to 500 mol, more preferably 50-200 mol, of ethylene oxide per mole of alcohol. Examples include the commercially available compound Brij S 100-PA (SC) of the Croda company.

The proportion of water-soluble moieties that are not linked to hydrophobic moieties in the polymeric booster should be as low as possible, 20% by weight, for example.

In a preferred embodiment, the booster is in the form of a hydrophilic polymeric additive consisting of a water-soluble moiety having a hydrophobic, water-insoluble group with a molecular weight of from 80 to 500 g/mol on one chain terminal, preferably the mass ratio of the water-soluble moiety to the hydrophobic, water-insoluble groups being from 5 to 200. In one embodiment, the booster consists of a linear water-soluble polymer bearing a hydrophobic, water-insoluble group on one chain terminal. Said hydrophobic, water-insoluble group preferably has a molecular weight of from 110 to 500 g/mol, more preferably a molecular weight of from 110 to 280 g/mol. The ratio of molecular weights of the water-soluble moiety to the hydrophobic, water-insoluble groups is preferably from 5 to 50.

In a particularly preferred embodiment, the booster consists of one alcohol ethoxylate of a $C_8$-$C_{20}$ alcohol with from 25 to 500 ethoxy groups, preferably from 50 to 200 ethoxy groups.

In another preferred embodiment, the booster is present in an amount of from 3 to 20% by weight, preferably from 5 to 15% by weight, especially from 7 to 15% by weight, respectively based on the total weight of components c), d) and e).

In a preferred embodiment, the aqueous microemulsions according to the invention contain components c)+d)+e) in an amount of from 2 to 20% by weight, preferably from 3 to 15% by weight, more preferably from 3 to 10% by weight, especially from 3 to 8% by weight, or from 4 to 8% by weight, respectively based on the total weight of the microemulsion.

The microemulsions according to the invention can be used as cleaning agents in the private as well as the commercial fields. It is particularly advantageous that the aqueous microemulsions can be employed as neutral cleaners and thus replace the aggressive alkaline cleaners known in the prior art for removing oily soils, such as paint residues. In one embodiment, the microemulsions according to the invention have a pH of from 4 to 11, preferably from 5 to 9.

In addition, the microemulsions according to the invention can have further additives. Suitable additives include, for example, mono-, di- or triethylene glycol monoalkyl ethers or -aryl ethers, such as ethylene glycol propyl ether, ethylene glycol butyl ether (butyl glycol), ethylene glycol hexyl ether, diethylene glycol methyl ether, diethylene glycol ethyl ether, diethylene glycol butyl ether (butyl diglycol), diethylene glycol hexyl ether, triethylene glycol methyl ether, triethylene glycol ethyl ether, triethylene glycol butyl ether, ethylene glycol phenyl ether; mono-, di- or tripropylene glycol monoalkyl ethers or -aryl ethers, such as propylene glycol methyl ether, propylene glycol ethyl ether, propylene glycol n-propyl ether, propylene glycol butyl ether, dipropylene glycol methyl ether, dipropylene glycol n-propyl ether, dipropylene glycol butyl ether, tripropylene glycol methyl ether, tripropylene glycol butyl ether, propylene glycol phenyl ether; mono-, di- or triethylene glycol dialkyl ethers, mono-, di- or tripropylene glycol dialkyl ethers, such as dipropylene glycol dimethyl ether; N-alkylpyrrolidones with a $C_1$-$C_{12}$ alkyl radical, for example, N-ethylpyrrolidone, N-octylpyrrolidone, N-dodecylpyrrolidone.

In addition, biocides and/or colorants as well as antirust agents and antioxidants can be added.

The additives can be present in amounts of from 0.01 to 3% by weight, preferably from 0.1 to 1% by weight, based on the total weight of the microemulsion.

The microemulsions according to the invention can be in the form of oil-in-water or water-in-oil microemulsions. Preferably, they are in the form of a bicontinuous microemulsion. Bicontinuous microemulsions comprise two domains, a hydrophobic and a hydrophilic domain, in the form of extended coexisting and intertwined domains at whose interface stabilizing surface-active agents are enriched in a monomolecular layer. Microemulsions form very readily and spontaneously because of the very low interfacial tension when the individual components water, oil and a suitable surface-active system are mixed together. Since the domains have very small sizes on the order of a few nanometers in at least one dimension, microemulsions often appear visually transparent and are thermodynamically stable, i.e., without a time limit, in a particular range of temperatures, depending on the surface-active system employed. If microemulsions have low surfactant contents, they may also be turbid, and are nevertheless thermodynamically stable.

The microemulsion is particularly stable within a temperature range of from 10 to 40° C., especially from 5 to 60° C.

In another embodiment, the microemulsions according to the invention are stable within a temperature range of from <5° C. to >60° C.

In one embodiment, the microemulsion according to the invention may be a water-in-oil or oil-in-water droplet microemulsion, in which water droplets are surrounded by oil, or oil droplets are surrounded by water, respectively.

Bicontinuous microemulsions are particularly preferred.

Typically, the weight proportion of ester oil (component a)) in the mixture of ester oil and water is from 12 to 45% by weight, preferably from 23 to 38% by weight, based on the total weight of ester oil and water in the microemulsion.

The present invention further relates to a cleaning agent consisting of or comprising the microemulsion according to the invention.

The present invention further relates to the use of the microemulsion according to the invention as a cleaning agent, especially for removing oily soils or resins and polymer-like soils.

In one embodiment of the cleaning agent according to the invention, the proportion of components c) and d) is less than 15% by weight, especially less than 12% by weight, or less than 9% by weight, or less than 7% by weight, for example, 2.5 to 7% by weight, respectively based on the total weight of the cleaning agent. Depending of the field of application, this very low surfactant content enables the production of products that are not subject to hazard label requirements because of their surfactant content.

The cleaning agent according to the invention is particularly suitable as a replacement for organic solvents. This results in a reduction of the amount of organic solvents employed up to dispensing with aromatic solvents, which is advantageous in view of workplace protection and environmental protection. In addition, both the cleaning agents according to the invention and the microemulsions according to the invention contained therein exhibit increased flash points with respect to the organic phases contained therein.

Further, it is possible to use the cleaning agent according to the invention for cleaning off paints, especially partially dried or dry paints, lacquers and tarry compounds and adhesives, as an all-purpose cleaner and neutral cleaner in the household, in the industry and commercial field.

It is also recommendable to use the cleaning agent according to the invention for cleaning off aqueous-based and organic-based paints and lacquers, especially for the cleaning of paintbrushes.

The cleaning agent according to the invention may further be used for cleaning off paints, lacquers, oil and/or salt-like residues from metal and/or plastic surfaces.

Its use is recommendable for sensitive surfaces, especially those that are attacked by organic solvents or acidic or alkaline cleaning agents, such as aluminum surfaces. Thus, the cleaning agent according to the invention could replace organic cleaning agents in many fields of application.

In addition, the microemulsions according to the invention can also be used for cleaning in the printing industry, especially for removing printing inks and paper dust built up in printing machines and printing formes. They are suitable, for example, for removing water- or oil-based printing inks and radiation-curable printing ink. Further, the cleaning agent is applied in the cleaning of printing cylinders, printing rolls and surfaces of printing machines, preferably for cleaning printing machines for conventional printing as well as printing formes, for example, when the printing process is interrupted, or in non-impact printing methods. The conventional printing methods with printing formes in which the cleaning agent can be employed include planographic printing, gravure printing, letterpress printing, flexographic printing and screen printing, special emphasis being placed on offset printing and waterless offset printing. The non-impact printing methods without a printing forme include electrophotography, ionography, magnetography, ink jet printing and thermographic printing.

In another embodiment of the present invention, the microemulsion according to the invention is used for cleaning and/or removing compounds selected from the group consisting of inks, paints, grease, oils, resins, bitumen, tar, adhesive residues, sealing compositions, abraded rubber, cosmetics and makeup residues, as well as pyrolysis products of organic compounds, especially for cleaning and/or removing soils whose organic components are polymer-based, for example, paints, adhesives, sealing compositions, polymer foams, such as polyurethane foams.

The microemulsion according to the invention is particularly suitable for cleaning and/or removing partially dried paints and adhesives.

In a particularly preferred embodiment, the microemulsions according to the invention are used for cleaning tools contaminated with paint residues, especially tools for applying paints, such as paintbrushes, paint rollers or paint-spraying devices.

It has been found that the microemulsions according to the invention exhibit an excellent cleaning performance especially with polymer-based soils.

Surprisingly, it has also been found that the microemulsions according to the invention are suitable for removing organic pyrolysis products. In a particularly preferred embodiment, the microemulsions according to the invention are used for cleaning baking ovens, fireplace glass panels or a grill.

The present invention further relates to a process for cleaning, comprising the following steps:

a) applying a microemulsion according to the invention to a contaminated surface;
b) optionally allowing the microemulsion to act for some time; and
c) removing the contaminant.

Especially when polymer-based contaminants are removed, it has been found that an exposure time of preferably 1 minute to 2 days, more preferably 5 minutes to 1 hour, for example, 10 to 30 minutes, substantially facilitates the detaching of the polymer-based contaminant.

Extended exposure times are possible without any problems when using the niicroemulsions according to the invention, because their vapor pressure is low as compared to conventional solvent-based cleaning agents.

EXAMPLES

Components Employed

The potable water employed is characterized by the following properties; pH=8.0, sodium 14 mg/l, potassium 2.7 mg/l, calcium 60 mg/l, magnesium 14 mg/l, nitrate 34.9 mg/l, chloride 46.1 mg/l.

Rapeseed methyl ester (RME) is an ester oil supplied by the Overlack company.

Octyl octanoate (octanoic acid octyl ester) is an ester oil supplied by the Sigma Aldrich company.

Oleic acid ethyl ester supplied by the Sigma Aldrich company.

Methyl laurate supplied by the Sigma Aldrich company.

Di Basic Ester: A mixture of dimethyl succinate (33% by weight), dimethyl adipate (33% by weight), dimethyl glutarate (33% by weight), and methanol (0.2% by weight), supplied by the Caldic company.

Isopropyl myristate supplied by the Sigma Aldrich company.

Triumphnetzer ZSG (AOT, 1,4-bis(2-ethylhexyl) sulfosuccinate sodium salt is an anionic surfactant supplied by the Zschimmer and Schwarz company; proportion of active substance 69%).

Tween 21 is a polyoxyethylene(4) sorbitan monolaurate supplied by the Sigma Aldrich company, proportion of active substance 100%.

Tween 40 is a polyoxyethylene(20) sorbitan monopalmitate supplied by the Sigma Aldrich company, proportion of active substance 100%.

Tween 80 is a polyoxyethylene(20) sorbitan monooleate supplied by the Sigma Aldrich company, proportion of active substance 100%.

Emulan EL is an ethoxylated castor oil supplied by the BASF company, proportion of active substance 100%; HLB: 14.

Brij S100-PA-(SG) is a PEG-100 stearyl ether supplied by the Croda company, proportion of active substance 100%.

Novel TDA-40 is a PEG-40 isotridecyl ether supplied by the Sasol company, proportion of active substance 100%.

Novel 2426400 is a PEG $C_{20-28}$ alkyl ether, supplied by the Sasol company, with about 100 EO moieties, proportion of active substance 100%; HLB: 18.3.

Emuldac AS-80 is a PEG 80 $C_{16-18}$ alkyl ether supplied by the Sasol company, proportion of active substance 100%.

Potassium sodium tartrate tetrahydrate, trisodium citrate dihydrate, disodium hydrogenphosphate dihydrate, sodium gluconate (anhydrous), calcium chloride (anhydrous), sodium chloride (anhydrous).

Akachemie Solupast D Löser (0203) supplied by the PUFAS Werk KG: mixture of N-butyl acetate (50-100%), heavy petroleum distillates, treated with hydrogen (10-25%), and ethoxylated $C_{13}$ oxoalcohol (≤2.5%).

Paintbrush cleaner supplied by the PUFAS Werk KG: mixture of white spirit (50-100%), ethoxylated $C_{13}$ oxoalcohol (2.5-10%), light solvent naphtha (2.5-10%), 1,2,4-trimethylbenzene (2.5-10%), and dipropylene glycol monomethyl ether (2.5-10%).

Praktiker Buntlack rot, red paint based on alkyd resin, supplied by the Faust company.

Praktiker 2 in 1 Buntlack rot, red paint based on alkyd resin, supplied by the Faust company.

Acrylic sealing composition supplied by the Faust company.

Construction silicone supplied by the Faust company.

Pattex Gel, adhesive supplied by the Henkel company.

Paintbrush supplied by the Wistoba company, No. 1000 02, light-colored bristles, width 14 mm, length 33 mm.

Stainless steel plates (material No. 1.4571).

The temperature stability of the microemulsions was determined in a temperature-controlled vessel by visual inspection. The temperature phase boundaries of the one-phase microemulsion range could be recognized from the drastically increasing turbidity when leaving the stability window by exceeding its upper limit or falling below its lower limit. Lamellar phases were determined by means of crossed polarizers. In the stability ranges stated for the Examples, microemulsions can coexist with lamellar phases.

The total surfactant contents refer to the active substance fractions of the surfactant components and of the booster. All percentages refer to the weights of the ingredients.

Example 1

Triumphnetzer: 10.72%
Tween 21: 4.21%
Octyl octanoate: 21.52%
Water: 61.53%
Potassium sodium tartrate tetrahydrate: 0.73%
Brij S100-PA-(SG): 1.29%

The stability range of the microemulsion is from 5° C. to 34° C., and its total surfactant content is 12.9%.

Example 2

Triumphnetzer: 7.24%
Tween 21: 6.45%
Octyl octanoate: 21.24%
Water: 62.00%
Potassium sodium tartrate tetrahydrate: 1.77%
Brij S100-PA-(SG): 1.30%

The stability range of the microemulsion is from <0° C. to 45° C., and its total surfactant content is 12.7%.

Example 3

Triumphnetzer: 8.22%
Tween 21: 5.99%
Octyl octanoate: 21.22%
Water: 61.87%
Disodium hydrogenphosphate dihydrate: 1.40%
Brij S100-PA-(SG): 1.30%

The stability range of the microemulsion is from <0° C. to 44° C., and its total surfactant content is 13.0%.

Example 4

Triumphnetzer: 10.70%
Tween 21: 4.05%
Octyl octanoate: 21.38%
Water: 61.18%
Sodium gluconate: 1.41%
Brij S100-PA-(SG): 1.28%

The stability range of the microemulsion is from 5° C. to 38° C., and its total surfactant content is 12.7%.

Example 5

Triumphnetzer: 6.91%
Tween 40: 5.89%
Oleic acid ethyl ester: 26.14%
Water: 58.93%
$CaCl_2$: 0.94%
Brij S100-PA-(SG): 1.19%

The stability range of the microemulsion is from <0° C. to 48° C., and its total surfactant content is 11.9%.

Example 6

Triumphnetzer: 12.52%
Tween 21: 4.73%
Octyl octanoate: 24.99%
Water: 55.58%
Trisodium citrate dihydrate: 0.71%
Brij S100-PA-(SG): 1.47%

The stability range of the microemulsion is from <0° C. to 45° C., and its total surfactant content is 14.8%.

Example 7

Triumphnetzer: 8.96%
Tween 21: 5.29%
Octyl octanoate: 33.95%
Water: 49.33%
Trisodium citrate dihydrate: 1.17%
Brij S100-PA-(SG); 1.30%

The stability range of the microemulsion is from <0° C. to 43° C., and its total surfactant content is 12.8%.

Example 8

Triumphnetzer: 7.38%
Tween 21: 2.21%
Octyl octanoate: 22.24%
Water: 65.33%
Trisodium citrate dihydrate: 1.50%
Novel 24/26-100: 1.34%

The stability range of the microemulsion is from 5° C. to 30° C., and its total surfactant content is 8.7%.

Example 9

Triumphnetzer: 10.66%
Tween 21: 3.44%
Octyl octanoate: 21.19%
Water: 61.34%
Trisodium citrate dihydrate: 1.44%
Emuldac AS-80: 1.93%

The stability range of the microemulsion is from 5° C. to 35° C., and its total surfactant content is 12.7%.

Example 10

Triumphnetzer: 8.52%
Tween 21: 6.27%
Octyl octanoate: 21.14%
Water: 61.99%
Trisodium citrate dihydrate: 1.44%
Novel TDA-40: 0.64%

The stability range of the microemulsion is from <0° C. to 45° C., and its total surfactant content is 12.8%.

Example 11

Triumphnetzer: 11.56%
Tween 40: 3.47%
Oleic add ethyl ester: 21.29%
Water: 61.07%
Trisodium citrate dihydrate: 1.32%
Brij S100-PA-(SG): 1.29%

The stability range of the microemulsion is from 6° C. to 47° C., and its total surfactant content is 12.7%.

Example 12

Triumphnetzer: 8.35%
Tween 40: 3.11%
Methyl laurate: 26.41%

Water: 60.26%
Trisodium citrate dihydrate: 0.88%
Brij S100-PA-(SG): 0.99%

The stability range of the microemulsion is from <0° C. to 53° C., and its total surfactant content is 9.9%.

Example 13

Triumphnetzer: 6.56%
Emulan EL: 1.61%
RME: 27.76%
Water: 62.87%
NaCl: 0.47%
Brij S100-PA-(SG): 0.73%

The stability range of the microemulsion is from below 10° C. to 30° C., and its total surfactant content is 6.9%.

Example 14

Triumphnetzer: 7.44%
Tween 21: 5.50%
Octyl octanoate: 12.88%
Di Basic Ester: 8.74%
Water: 62.81%
Trisodium citrate dihydrate: 1.46%
Brij S100-PA-(SG): 1.17%

The stability range of the microemulsion is from <0° C. to >60° C., and its total surfactant content is 11.8%.

Example 15

Triumphnetzer: 8.35%
Tween 21: 5.79%
Octyl octanoate: 21.20%
Water: 61.94%
Trisodium citrate dihydrate: 1.43%
Brij S100-PA-(SG): 1.29%

The stability range of the microemulsion is from <0° C. to 44° C., and its total surfactant content is 12.8%.

Example 16

Triumphnetzer: 8.39%
Tween 40: 6.04%
Methyl laurate: 29.83%
Water: 53.32%
Trisodium citrate dihydrate: 1.15%
Brij S100-PA-(SG): 1.27%

The stability range of the microemulsion is from <0° C. to more than 60° C., and its total surfactant content is 13.1%.

Example 17

Triumphnetzer: 6.94%
Tween 80: 6.00%
Oleic add ethyl ester: 26.07%
Water: 58.87%
$CaCl_2$: 0.95%
Brij S100-PA-(SG): 1.17%

The stability range of the microemulsion is from <0° C. to 48° C., and its total surfactant content is 12.0%.

Example 18

Triumphnetzer: 5.24%
Tween 21: 4.74%
Octyl octanoate: 26.70%
Water: 61.41%
Trisodium citrate dihydrate: 1.29%
Brij S100-PA-(SG): 0.62%

The stability range of the microemulsion is from <0° C. to 33° C., and its total surfactant content is 9.0%.

Example 19

Triumphnetzer; 11.51%
Tween 21: 3.61%
Octyl octanoate; 21.35%
Water: 61.17%
Potassium sodium tartrate tetrahydrate: 1.05%
Brij S100-PA-(SG): 1.31%

The stability range of the microemulsion is from 12° C. to 50° C., and its total surfactant content is 12.9%.

Example 20

Triumphnetzer: 8.92%
Tween 21; 4.40%
Isopropyl myristate: 25.78%
Water: 58.35%
Trisodium citrate dihydrate: 1.37%
Brij S100-PA-(SG): 1.18%

The stability range of the microemulsion is from 16.5° C. to 50° C., and its total surfactant content is 11.7%, Cleaning Examples Cleaning tests were performed with oil-soluble paint (Praktiker Buntlack, based on alkyd resin) and water-soluble paint (Praktiker 2 in 1 Buntlack, based on acrylic resin), test being performed with both fresh and dried paints.

Cleaning of Fresh Oil-Soluble Paint from Paintbrushes

To the paintbrushes to be cleaned, 1.2 g Praktiker Buntlack based on alkyd resin was applied, followed by pressing it out several times on the beaker bottom in 100 ml each of cleaning agent, and rinsed out with running water. As the cleaning agents, there were used the microemulsion mixtures 1, 12, 14, and the paintbrush cleaner of the Pufas company as a Comparative Example. In all cases, the paint was essentially removed from the paintbrush.

Cleaning of Dried Oil-Soluble Paint from Paintbrushes

To the paintbrushes to be cleaned, 1.2 g Praktiker Buntlack based on alkyd resin was applied, and dried for 24 hours. Subsequently, the paintbrushes were soaked in a beaker in 100 ml each of cleaning agent for 48 hours. Thereafter, the paintbrushes were pressed out several times on the beaker bottom, and rinsed out with running water. As the cleaning agents, there were used the microemulsion mixtures 12 and 14. After pressing out and washing with water, the dried paint was essentially removed in all cases.

Cleaning of Dried Water-Soluable Paint from Paintbrushes

To the paintbrushes to be cleaned, 1.5 g Praktiker 2 in 1 Buntlack based on acrylic resin was applied, and dried for 24 hours. Subsequently, the paintbrushes were soaked in a beaker in 100 ml each of cleaning agent for 48 hours. Thereafter, the paintbrushes were pressed out several times on the beaker bottom, and rinsed out with running water. If the microemulsion mixtures 1, 12 and 14 were used as the cleaning agents, the paint residues detached from the paintbrush bristles as solid particles and could be essentially removed from the paintbrushes by rubbing off and rinsing with water. The paintbrush cleaner of the Pufas company could not remove the dried paint.

In addition, the cleaning agents were examined for their suitability to clean off contaminants from other materials. These tests were performed with acrylic sealing composition, construction silicone, and adhesive on stainless steel plates.

Cleaning Off of Solid Acrylic Sealing Composition

To the stainless steel plates (material No, 1.4571) cleaned with acetone, 0.25 g each of the acrylic sealing composition was applied on a surface area of about 40×40 mm, and dried in air for 24 hours. Thereafter, 0.5 g each of the microemulsion mixtures 1, 12 and 14 and of the Solupast Löser of Pufas was applied to the sealing composition. After an exposure time of two hours, the sealing composition could be scraped off with a spatula with little mechanical force in all cases. After an exposure time of 24 hours, the state was unchanged when the microemulsion mixtures were used, but in the case of the Solupast Löser, the sealing composition adhered strongly to the steel surface again.

Cleaning Off of Solid Silicone Sealing Composition

To the stainless steel plates cleaned with acetone, 0.40 g each of the silicone sealing composition was applied on a surface area of about 40×40 mm, and dried in air for 24 hours. Thereafter, 0.5 g each of the microemulsion mixtures 1, 12 and 14 and of the Solupast Löser of Pufas was applied to the silicone. After an exposure time of two hours, the sealing composition could be lifted off with a spatula with little mechanical force in all cases. After an exposure time of 24 hours, the state was unchanged when the microemulsion mixtures were used, but in the case of the Solupast Löser, the silicone composition adhered strongly to the steel surface again.

Cleaning Off of Dried Adhesive

To the stainless steel plates cleaned with acetone, 0.55 g each of the Pattex gel was applied on a surface area of about 40×40 mm, and dried in air for 24 hours. Thereafter, 0.5 g each of the microemulsion mixtures 1, 12 and 14 and of the Solupast Löser of Pufas was applied to the adhesive. After an exposure time of two hours, the adhesive could be scraped off with a spatula with little mechanical force in all cases. After an exposure time of 24 hours, the state was unchanged when the microemulsion mixtures were used, but in the case of the Solupast Löser, the adhesive adhered strongly to the steel surface again.

Comparative Examples

Comparative Experiments: Replacement of Hydrocarbon Oils by Ester Oils in Examples from WO 2008/132202

Examples 2 and 5 in WO 2008/132202 (pp. 24, 25) were recurred to for comparative experiments. In both cases, the oil component (Hydroseal G232H in Example 2 and Ketrul D85 in Example 5) was replaced by the carboxylic acid ester, rapeseed methyl ester (RME). In addition, the mass ratio of the two surfactant components (Span 20 and AG 6210 in Example 2, and Imwitor 928 and AG 6210 in Example 5) varies around the values stated in the Examples. It was thereby intended to find the optimum temperature stability range for the microemulsions.

Comparative Experiments for Example 2 from WO 2008/132202

Example 2 from WO 2008/132202 has the following composition (all figures are in % by weight):

| | |
|---|---|
| Water | 46.45 |
| Hydroseal G 232 H | 42.38 |
| AG 6210 | 5.39 |
| Span 20 | 4.88 |
| Brij 700 | 0.90 |

The mixture can be characterized as follows from the surfactant point of view.

The surfactant components are AG 6210 (active content 60% by weight, the balance being water), Span 20 (active content 100% by weight), and Brij 700 (active content 100% by weight). All further figures are based on the active contents of the surfactants. The total surfactant content in the above Example is 9.0%.

The mass proportion of AG 6210 in admixture with Span 20 (Delta) is 39.9%.

$$\text{Delta} = \frac{m\,(\text{active content of AG 6210})}{m\,(\text{active content of AG 6210}) + m\,(\text{Span 20})}$$

The mass proportion of polymeric booster (Brij 700) in the total surfactant mixture is 10.0%.

$$\text{Mass proportion of booster} = \frac{m\,(\text{Brij 700})}{m\,(\text{active content of AG 6210}) + m\,(\text{Span 20}) + m\,(\text{Brij 700})}$$

The stability range of the microemulsion phase is from 0 to 52° C.

If the oil component Hydroseal G 232 H is replaced by RISE in Example 2 from WO 2008/132202, a microemulsion phase cannot be produced. The mixture of surfactants is not efficient enough to emulsify all the water and oil as a microemulsion.

Therefore, the total surfactant content in the Comparative Examples was increased to about 30%. Delta was varied around the value in Example 2 from WO 2008/132202; the mass proportion of the booster and the mass ratio of water to oil were kept constant at the values of Example 2 from WO 2008/132202.

The following Table 1 shows the stability ranges of the microemulsions as a function of the total surfactant content as well as of delta. The compositions of the individual mixtures (Comparative Examples 1 to 15) are stated in Table 3.

The temperature behavior of the mixtures was measured up to 75° C. Higher temperatures are not relevant for most applications.

| Delta in % | 24.9 | 29.6 | 35.1 | 39.2 | 45.3 | 50.1 |
|---|---|---|---|---|---|---|
| Total surfactant content, % | | 30.1 | 29.9 | 29.9 | 29.5 | 29.4 |
| Microemulsion stability range | | ≥63° C. (Comp. Ex. 1) | ≥59° C. (Comp. Ex. 2) | ≥52° C. (Comp. Ex. 3) | — (Comp. Ex. 4) | — (Comp. Ex. 5) |

-continued

| Delta in % | 24.9 | 29.6 | 35.1 | 39.2 | 45.3 | 50.1 |
|---|---|---|---|---|---|---|
| Total surfactant content, % Microemulsion stability range | | 25.3 ≥64° C. (Comp. Ex. 6) | 25.2 ≥57° C. (Comp. Ex. 7) | 25.1 — (Comp. Ex. 8) | 25.0 — (Comp. Ex. 9) | 25.0 — (Comp. Ex. 10) |
| Total surfactant content, % Microemulsion stability range | | 20.0 ≥63° C. (Comp. Ex. 11) | 20.1 — (Comp. Ex. 12) | | | |
| Total surfactant content, % Microemulsion stability range | 16.6 ≥69° C. (Comp. Ex. 13) | 16.0 — (Comp. Ex. 14) | | | | |
| Total surfactant content, % Microemulsion stability range | 15.0 — (Comp. Ex. 15) | | | | | |

The Comparative Examples 1 to 15 show that, when the hydrocarbon oil is replaced by ester oil, microemulsion phases form only at total surfactant concentrations of above 16%. Apart from the rather high temperatures at which the microemulsion phases occur, the temperature windows are also rather narrow.

Comparative Examples Relating to Example 5 of WO 2008/132202

Example 5 from WO 2008/132202 has the following composition (all figures in % by weight):

| | |
|---|---|
| Water | 43.84 |
| Ketrul D85 | 48.41 |
| AG 6210 | 3.94 |
| Imwitor 928 | 3.22 |
| C12E190 | 0.59 |

The mixture can be characterized as follows from the surfactant point of view.

The surfactant components are AG 6210 (active content 60% by weight, the balance being water), Imwitor 928 (active content 100% by weight), and C12E190 (active content 100% by weight). All further figures are based on the active contents of the surfactants.

The total surfactant content in the above Example is 6.2%.

The mass proportion of AG 6210 in admixture with Imwitor 928 (Delta) is 42.3%, $$\text{Delta} = \frac{m\,(\text{active content of AG 6210})}{m\,(\text{active content of AG 6210}) + m\,(\text{Imwitor 928})}$$

The mass proportion of polymeric booster (C12E190) in the total surfactant mixture is 9.6%.

$$\text{Mass proportion of booster} \frac{m(C12E190)}{m\,(\text{active content of AG 6210}) + m\,(\text{Imwitor 928}) + m\,(C12E190)}$$

The stability range of the microemulsion phase is from 15 to 75° C.

If the oil component Ketrul D85 is replaced by RME in Example 5 from WO 2008/132202, a microemulsion phase cannot be produced. The mixture of surfactants is not efficient enough to emulsify all the water and oil as a microemulsion.

Therefore, the total surfactant content in the Comparative Examples was increased to about 28%. Delta was varied around the value in Example 5 from WO 2008/132202; the mass proportion of the booster and the mass ratio of water to oil were kept constant at the values of Example 5 from WO 2008/132202. In Comparative Examples 16 to 38, Brij 700 was used as the booster, which behaves the same as C12E190 in terms of surfactant properties.

The following Table 2 shows the stability ranges of the microemulsions as a function of the total surfactant content as well as of delta. The compositions of the individual mixtures (Comparative Examples 16 to 38) are stated in Tables 4a-e.

The temperature behavior of the mixtures was measured up to 75° C. Higher temperatures are not relevant for most applications.

TABLE 2

| Delta in % | 23.0 | 27.8 | 32.1 | 36.9 | 39.6 | 41.9 | 46.6 |
|---|---|---|---|---|---|---|---|
| Total surfactant content, % Microemulsion stability range | | 28.5 72-74° C. (Comp. Ex. 16) | 28.5 ≥66° C. (Comp. Ex. 17) | 28.6 ≥62° C. (Comp. Ex. 18) | 28.4 ≥59° C. (Comp. Ex. 19) | 28.4 56-74° C. (Comp. Ex. 20) | — (Comp. Ex. 21) |
| Total surfactant content, % Microemulsion stability range | | 22.7 67-72° C. (Comp. Ex. 22) | 22.4 ≥67° C. (Comp. Ex. 23) | 22.6 ≥63° C. (Comp. Ex. 24) | 22.5 — (Comp. Ex. 25) | 22.6 — (Comp. Ex. 26) | |
| Total surfactant | | 20.0 | 20.0 | 20.0 | 20.0 | 20.0 | |

TABLE 2-continued

| Delta in % | 23.0 | 27.8 | 32.1 | 36.9 | 39.6 | 41.9 | 46.6 |
|---|---|---|---|---|---|---|---|
| content, % Microemulsion stability range | | 69-74° C. (Comp. Ex. 27) | ≥66° C. (Comp. Ex. 28) | — (Comp. Ex. 29) | — (Comp. Ex. 30) | — (Comp. Ex. 31) | |
| Total surfactant content, % Microemulsion stability range | | 18.1 ≥69° C. (Comp. Ex. 32) | 18.0 66-74° C. (Comp. Ex. 33) | | | | |
| Total surfactant content, % Microemulsion stability range | 14.9 ≥74° C. (Comp. Ex. 34) | 15.0 ≥69° C. (Comp. Ex. 35) | 15.0 — (Comp. Ex. 36) | | | | |
| Total surfactant content, % Microemulsion stability range | 13.0 — (Comp. Ex. 37) | 13.1 — (Comp. Ex. 38) | | | | | |

The Comparative Examples 16 to 38 show that, when the hydrocarbon oil is replaced by ester oil, microemulsion phases form only at total surfactant concentrations from about 15%. Apart from the rather high temperatures at which the microemulsion phases occur, the temperature windows are also rather narrow.

CONCLUSION

Replacing the hydrocarbon of by ester oil in Examples 2 and 5 from WO 2008/132202 results in microemulsion systems with rather narrow temperature stability windows. In addition, relatively high total surfactant concentrations are necessary. In contrast, the surfactant mixtures according to the invention allow significantly lower total surfactant concentrations for ester oils and also wider temperature windows, which are, in addition, in a temperature range that is more suitable for cleaning agent applications (see Examples 1-20).

Composition of the Microemulsion Mixtures in Mass Percent

For AG 6210, the figures refer to a 60% aqueous solution. For all other substances, the active content is 100%.

The mass ratio of water to RME was kept constant for Comparative Examples 1 to 15 (Tables 3a-c) and 16 to 38 (Tables 4a-e), respectively, for systematic reasons. The water content is the sum of the water proportion stated in the Tables and the water content of AG 6210. Minute deviations between the Examples are of negligible importance to the phase behavior of the mixtures.

Comparative Examples Relating to Example 2 from WO 2008/132202

TABLE 3a

| | Comp. Ex. 1 | Comp. Ex. 2 | Comp. Ex. 3 | Comp. Ex. 4 | Comp. Ex. 5 |
|---|---|---|---|---|---|
| Water | 31.94 | 31.54 | 30.41 | 30.12 | 29.69 |
| RME | 32.61 | 32.64 | 32.70 | 32.35 | 32.12 |
| AG 6210 | 13.39 | 15.58 | 17.58 | 20.06 | 22.09 |
| Span 20 | 19.10 | 17.29 | 16.36 | 14.55 | 13.20 |
| Brij 700 | 2.96 | 2.95 | 2.95 | 2.92 | 2.90 |

TABLE 3b

| | Comp. Ex. 6 | Comp. Ex. 7 | Comp. Ex. 8 | Comp. Ex. 9 | Comp. Ex. 10 |
|---|---|---|---|---|---|
| Water | 35.11 | 34.77 | 33.60 | 32.95 | 32.19 |
| RME | 35.13 | 35.07 | 35.36 | 35.25 | 35.26 |
| AG 6210 | 11.24 | 13.12 | 14.79 | 17.00 | 18.83 |
| Span 20 | 16.04 | 14.56 | 13.77 | 12.33 | 11.25 |
| Brij 700 | 2.48 | 2.48 | 2.48 | 2.47 | 2.47 |

TABLE 3c

| | Comp. Ex. 11 | Comp. Ex. 12 | Comp. Ex. 13 | Comp. Ex. 14 | Comp. Ex. 15 |
|---|---|---|---|---|---|
| Water | 38.72 | 38.45 | 43.40 | 41.17 | 44.34 |
| RME | 37.64 | 37.48 | 37.52 | 39.97 | 38.44 |
| AG 6210 | 8.93 | 10.47 | 6.15 | 7.12 | 5.55 |
| Span 20 | 12.74 | 11.62 | 11.13 | 10.17 | 10.05 |
| Brij 700 | 1.97 | 1.98 | 1.80 | 1.57 | 1.62 |

Comparative Examples Relating to Example 5 from WO 2008/132202

TABLE 4a

| | Comp. Ex. 16 | Comp. Ex. 17 | Comp. Ex. 18 | Comp. Ex. 19 | Comp. Ex. 20 |
|---|---|---|---|---|---|
| Water | 29.94 | 29.08 | 28.19 | 28.06 | 27.63 |
| RME | 36.75 | 36.84 | 36.85 | 36.74 | 36.77 |
| AG 6210 | 11.95 | 13.88 | 15.96 | 16.96 | 17.98 |
| Imwitor 928 | 18.63 | 17.49 | 16.28 | 15.51 | 14.92 |
| Brij 700 | 2.73 | 2.71 | 2.74 | 2.73 | 2.70 |

TABLE 4b

| | Comp. Ex. 21 | Comp. Ex. 22 | Comp. Ex. 23 | Comp. Ex. 24 | Comp. Ex. 25 |
|---|---|---|---|---|---|
| Water | 27.29 | 34.03 | 33.37 | 32.69 | 32.75 |
| RME | 36.47 | 39.49 | 39.91 | 39.64 | 39.36 |
| AG 6210 | 19.72 | 9.50 | 10.82 | 12.60 | 13.42 |
| Imwitor 928 | 13.87 | 14.81 | 13.72 | 12.92 | 12.26 |
| Brij 700 | 2.65 | 2.17 | 2.18 | 2.15 | 2.21 |

TABLE 4c

| | Comp. Ex. 26 | Comp. Ex. 27 | Comp. Ex. 28 | Comp. Ex. 29 | Comp. Ex. 30 |
|---|---|---|---|---|---|
| Water | 31.66 | 35.67 | 34.91 | 34.48 | 34.32 |
| RME | 39.94 | 40.95 | 41.28 | 41.05 | 40.91 |
| AG 6210 | 14.33 | 8.39 | 9.64 | 11.14 | 11.92 |
| Imwitor 928 | 11.91 | 13.08 | 12.23 | 11.43 | 10.89 |
| Brij 700 | 2.16 | 1.91 | 1.94 | 1.90 | 1.96 |

TABLE 4d

| | Comp. Ex. 31 | Comp. Ex. 32 | Comp. Ex. 33 | Comp. Ex. 34 | Comp. Ex. 35 |
|---|---|---|---|---|---|
| Water | 33.67 | 36.91 | 36.29 | 39.62 | 38.89 |
| RME | 41.27 | 41.98 | 42.22 | 43.43 | 43.61 |
| AG 6210 | 12.64 | 7.57 | 8.70 | 5.17 | 6.28 |
| Imwitor 928 | 10.51 | 11.81 | 11.04 | 10.36 | 9.79 |
| Brij 700 | 1.91 | 1.73 | 1.75 | 1.42 | 1.43 |

TABLE 4e

| | Comp. Ex. 36 | Comp. Ex. 37 | Comp. Ex. 38 |
|---|---|---|---|
| Water | 38.30 | 40.78 | 40.13 |
| RME | 43.80 | 44.42 | 44.60 |
| AG 6210 | 7.25 | 4.51 | 5.48 |
| Imwitor 928 | 9.19 | 9.05 | 8.54 |
| Brij 700 | 1.46 | 1.24 | 1.25 |

The invention claimed is:

1. An aqueous microemulsion, comprising:

a) one or more liquid carboxylic acid ester(s), wherein said liquid carboxylic acid ester has from 6 to 22 carbon atoms;

b) one or more water-soluble salt(s) with one or more cation(s);

c) one or more salt(s) of sulfosuccinate esters;

d) one or more non-ionic surfactant(s) selected from alkoxylated sorbitan ester and alkoxylated vegetable oil; and e) 3 to 20% by weight, based on the total weight of components c), d), and e) of one or more booster(s), wherein said booster is an alcohol ethoxylate of a $C_8$-$C_{20}$ alcohol with from 25 to 500 ethoxy groups.

2. The aqueous microemulsion according to claim 1, characterized in that said liquid carboxylic acid ester has from 10 to 22 carbon atoms.

3. The aqueous microemulsion according to claim 1, characterized in that said liquid carboxylic acid ester is selected from the group consisting of esters of a monohydric alcohol and a mono- or dicarboxylic acid, and esters of a dihydric alcohol and a monocarboxylic acid, more preferably esters of monohydric alcohols with monocarboxylic acids.

4. The aqueous microemulsion according to claim 1, characterized in that said liquid carboxylic acid ester is an ester derived from a $C_{10}$-$C_{22}$ monocarboxylic acid and methanol, preferably dodecanoic acid methyl ester or rapeseed oil methyl ester.

5. The aqueous microemulsion according to claim 1, characterized in that said liquid carboxylic acid ester is a mixture of monocarboxylic acids with 10 to 22 carbon atoms and dicarboxylic acid methyl esters with 6 to 10 carbon atoms.

6. The aqueous microemulsion according to claim 1, characterized in that said liquid carboxylic acid ester is contained in an amount of from 10 to 40% by weight based on the total weight of the microemulsion.

7. The aqueous microemulsion according to claim 1, characterized in that the weight ratio of the liquid carboxylic acid ester (component a)) to the sum of components c), d) and e) is from 1.5 to 10.

8. The aqueous microemulsion according to claim 1, characterized in that said salt of sulfosuccinate esters is an alkali metal salt.

9. The aqueous microemulsion according to claim 1, characterized in that said salt of sulfosuccinate esters is selected from the group consisting of diesters of sulfosuccinic acid alkali salt with $C_6$-$C_{10}$ alcohols, monoesters of sulfosuccinic acid dialkali salt with $C_8$-$C_{12}$ alcohols, and monoesters of sulfosuccinic acid dialkali salt with ethoxylated $C_{10}$-$C_{14}$ alcohols.

10. The aqueous microemulsion according to claim 1, characterized in that said salt of sulfosuccinate esters is a sodium salt.

11. The aqueous microemulsion according to claim 1, characterized in that said salt of sulfosuccinate esters is a sodium salt of bis(2-ethylhexyl) sulfosuccinate.

12. The aqueous microemulsion according to claim 1, characterized in that said salt of sulfosuccinate esters is contained in an amount of from 1 to 10% by weight based on the total weight of the microemulsion.

13. The aqueous microemulsion according to claim 1, characterized in that said salt of sulfosuccinate esters is contained in an amount of from 30 to 75% by weight based on the total weight of components c), d) and e).

14. The aqueous microemulsion according to claim 1, characterized in that said non-ionic surfactant is ethoxylated sorbitan ester, or ethoxylated vegetable oil, or a combination thereof.

15. The aqueous microemulsion according to claim 1, characterized in that said non-ionic surfactant is an ethoxylated sorbitan monoester with a saturated or unsaturated $C_{12}$-$C_{18}$ fatty acid radical.

16. The aqueous microemulsion according to claim 1, characterized in that said non-ionic surfactant is ethoxylated castor oil.

17. The aqueous microemulsion according to claim 1, characterized in that said non-ionic surfactant is an ethoxylated sorbitan ester and/or ethoxylated vegetable oil having an HLB value of from 11 to 17.

18. An aqueous microemulsion, comprising:

a) one or more liquid carboxylic acid ester(s), wherein said liquid carboxylic acid ester has from 6 to 22 carbon atoms;

b) one or more water-soluble salt(s) with one or more cation(s);

c) one or more salt(s) of sulfosuccinate esters;

d) one or more non-ionic surfactant(s) selected from alkoxylated sorbitan ester and alkoxylated vegetable oil; and e) 3 to 20% by weight, based on the total weight of components c), d), and e) of one or more booster(s), wherein said booster is in the form of a hydrophilic polymeric additive consisting of a water-soluble moiety having a hydrophobic, water-insoluble group with a molecular weight of from 80 to 500 g/mol on at least one chain terminal, and the molar mass ratio of the water-soluble moiety to the hydrophobic, water-insoluble groups is from 7 to 200.

19. The aqueous microemulsion according to claim 1, characterized in that said booster is an alcohol ethoxylate of a $C_8$-$C_{20}$ alcohol with from 50 to 200 ethoxy groups.

20. The aqueous microemulsion according to claim 1, characterized in that said booster is contained in an amount of from 5 to 15% by weight based on the total weight of components c), d) and e).

21. The aqueous microemulsion according to claim 1, characterized in that said salt is selected from the group consisting of sodium sulfate, sodium chloride, sodium gluconate, sodium citrate, trisodium phosphate, disodium hydrogenphosphate, potassium sulfate, potassium chloride, ammonium sulfate, ammonium chloride, magnesium sulfate, magnesium chloride, calcium chloride, calcium acetate, and magnesium acetate.

22. The aqueous microemulsion according to claim 1, characterized in that said salt is an acetate.

23. The aqueous microemulsion according to claim 1, characterized in that said salt is contained in an amount of from 0.1 to 4.0% by weight based on the total weight of the microemulsion.

24. The aqueous microemulsion according to claim 1, characterized in that the sum of components c), d) and e) is an amount of from 2 to 20% by weight based on the total weight of the microemulsion.

25. The aqueous microemulsion according to claim 1, characterized in that said microemulsion is in the form of a bicontinuous microemulsion.

26. The microemulsion according to claim 1, wherein the microemulsion is a cleaning agent for removing oily soils.

27. The microemulsion according to claim 1, wherein the microemulsion cleans, removes, or cleans and removes compounds selected from the group consisting of inks, paints, grease, oils, resins, bitumen, tar, adhesive residues, sealing compositions, abraded rubber, cosmetics and makeup residues, and pyrolysis products of organic compounds, especially for cleaning and/or removing soils whose organic components are polymer-based, including paints, adhesives, sealing compositions, or polymer foams.

28. The microemulsion according to claim 1, wherein the emulsion cleans tools contaminated with paint residues, especially tools for applying paints, including paintbrushes, paint rollers or paint-spraying devices.

29. The microemulsion according to claim 1, wherein the emulsion cleans baking ovens, fireplace glass panels or a grill.

30. A process for cleaning, comprising the following steps:

a) applying a microemulsion according to claim 1 to a contaminated surface;

b) optionally allowing the microemulsion to act for some time; and c) removing the contaminant.

* * * * *